United States Patent [19]

Rapp

[11] Patent Number: 4,512,607

[45] Date of Patent: Apr. 23, 1985

[54] DETACHABLE PATIENT SERVING TRAYS

[76] Inventor: Edward D. Rapp, 500 N. Osceola, Clearwater, Fla. 33515

[21] Appl. No.: 483,519

[22] Filed: Apr. 11, 1983

[51] Int. Cl.[3] ..... A47B 23/02; A47B 83/02

[52] U.S. Cl. ..... 297/153; 108/49; 108/89; 297/148

[58] Field of Search ..... 297/148, 153, 155; 108/44, 47, 89, 49, 54.1, 83, 88

[56] References Cited

U.S. PATENT DOCUMENTS

| | | | |
|---|---|---|---|
| 1,008,037 | 11/1911 | Johnson | 297/153 |
| 1,247,161 | 11/1917 | Silverman | 297/148 X |
| 1,368,802 | 2/1921 | Johnson | 297/155 X |
| 2,548,927 | 4/1951 | Anderson | 108/78 |
| 3,202,117 | 9/1965 | Zimmerman | 108/89 |
| 3,346,125 | 10/1967 | Miller et al. | 108/47 X |
| 3,813,714 | 6/1974 | Sater | 297/148 X |
| 4,404,698 | 9/1983 | Koncelik et al. | 297/153 X |

*Primary Examiner*—William E. Lyddane
*Assistant Examiner*—Peter R. Brown
*Attorney, Agent, or Firm*—Ronald E. Smith

[57] ABSTRACT

Detachably mounted patient serving trays. A pair of laterally extensible handle members are slidably mounted at opposite ends of a base member that provides a support surface for food or other items disposed thereatop. Clamping members specifically designed to releasably engage tubular structures are fixedly secured and depend to each handle member so that preselected tubular portions of a bed, chair, wheelchair, or other bodily support structure may be releasably engaged by such clamping members. The handle members are positionable in an infinite plurality of functional positions of adjustment so that the tray may be used in conjunction with bodily support structures of differing sizes and shapes. The design also permits storage of the tray on the frame of any bodily support structure of tubular construction.

3 Claims, 6 Drawing Figures

DETACHABLE PATIENT SERVING TRAYS

BACKGROUND OF THE INVENTION

1. Field of the Invention

This invention relates generally to patient serving trays, and more specifically relates to a tray that is releasably securable to a bed, chair, or wheelchair, both in an operative disposition and in a storage disposition.

2. Description of the Prior Art

A search of United States patents that was conducted prior to the filing of this disclosure located the following patents in the general field of this invention:

| Patentee | U.S. Pat. No. | Date of Issue |
|---|---|---|
| Hillenbrand | DES. 135,340 | 03/30/43 |
| Berner | DES. 162,119 | 02/27/51 |
| Paterniti | DES. 163,627 | 01/08/48 |
| Silkenat | DES. 186,181 | 09/22/59 |
| Sundberg/Ferar | DES. 192,809 | 05/15/62 |
| Armstrong | DES. 198,168 | 05/12/64 |
| Ballas | 4,077,333 | 03/07/78 |
| Sonder et al | DES. 261,837 | 11/17/81 |

It is well known that patients confined to bed or to a wheelchair are best served at mealtime by placing their food on a tray and positioning the tray relative to the patient at a convenient location. One very well-known apparatus that accomplishes the desired positioning of the tray is known as the overbed tray. Apparatuses of this type include a tray disposed in cantilever disposition relative to an upstanding support structure that is mounted on a base structure that is typically provided with wheels so that the entire apparatus may be rolled into its operative position when desired, and rolled to a storage location when the meal has been completed. These devices are large, and occupy expensive space.

There is a need for a patient serving tray that takes up less space than conventional overbed trays and that can be stored in a manner that does not take up valuable space. The ideal device would be storable on the patient's bed or wheelchair so that it would always be handy to retrieve.

J G Furniture Products, an affiliate of Burlington Industries, makes a serving tray that can also be used as a footboard for a bed. Accordingly, the tray may be used in one environment only, i.e., the environment of the bed for which it is specifically designed. Beds of differing sizes, or wheelchairs, or other bodily support stuctures of the type having tubular frames will not accommodate such device.

Clearly, there is a need for a patient serving tray having an adjustment feature so that it may be used on beds and chairs of widely varying configuration and dimension, but the needed tray does not appear in the prior art.

SUMMARY OF THE INVENTION

The longstanding but heretofore unfulfilled need for a patient serving tray that can be used with any bed or chair having a tubular frame is now provided in the form of a tray having a base member and a pair of oppositely positioned, laterally extendible handle members. Each handle is provided with a resilient clamping member that is specifically designed to releasably engage a tubular frame. Thus, lateral adjustment of the handles permits the detachable mounting of the tray assembly to virtually any structure having a tubular frame. The flexibility provided by the laterally extensible handles allows the tray to be detachably mounted at virtually any location on a tubular frame so that the tray is easily movable from its operative position to a storage position on the same tubular frame, one of said positions being an operative position and the other being a storage position.

It is therefore seen to be the primary object of this invention to provide a tray that obviates the need for conventional overbed trays.

A closely related object is to provide a tray of small construction so that it can be stored in a small space.

A more specific object is to provide a tray that may be stored at virtually any location on virtually any frame formed of tubular materials, such as a hospital bed or a wheelchair.

Another object is to provide a tray having laterally extensible mounting means so that it may be detachably secured to beds or chairs of differing dimensions.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
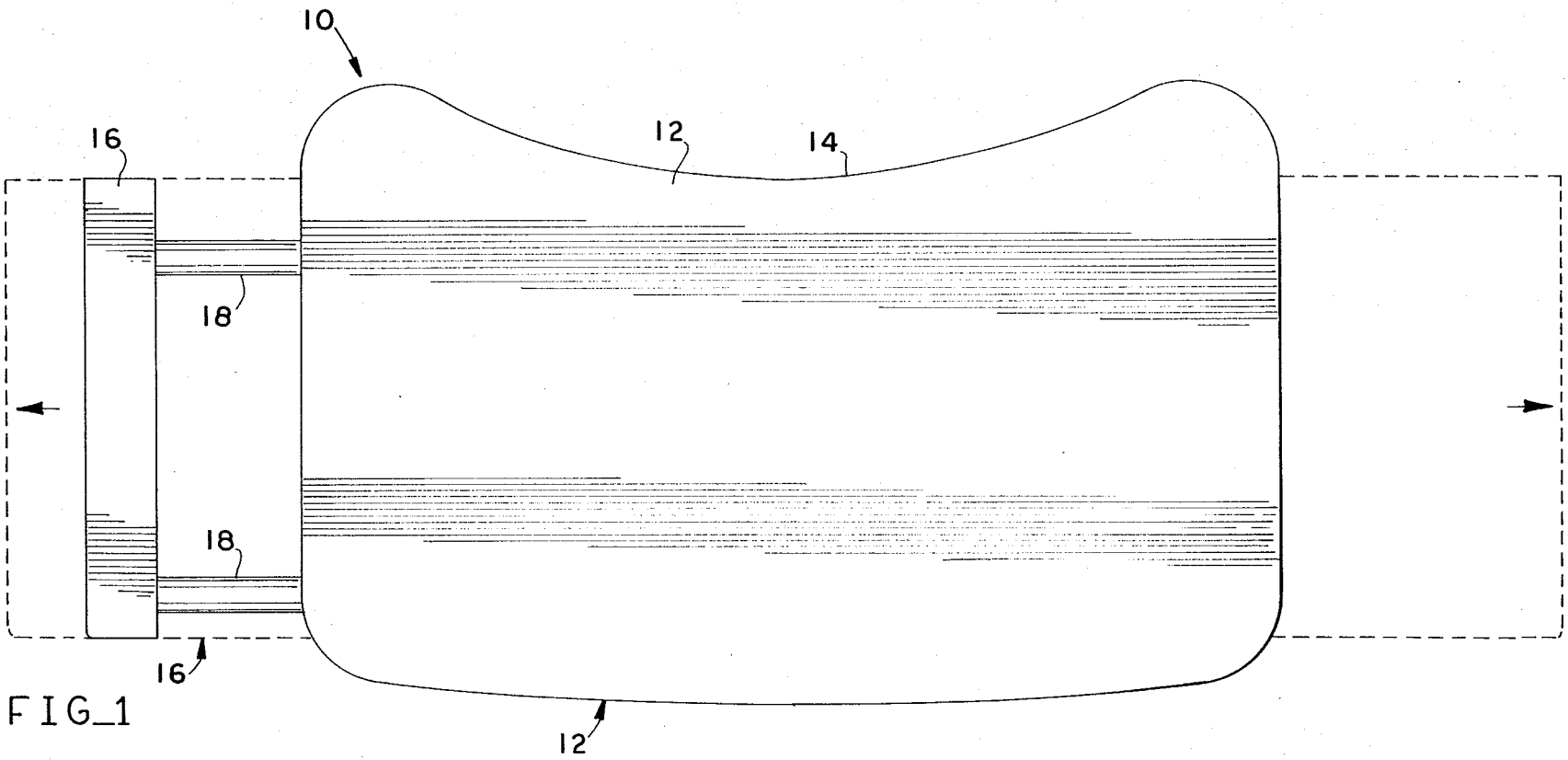
FIG. 1 is a top plan view of a first embodiment of the invention, showing one of the handle members in an extended position, and the other handle member in its stored, or unextended disposition.
Figure 2:
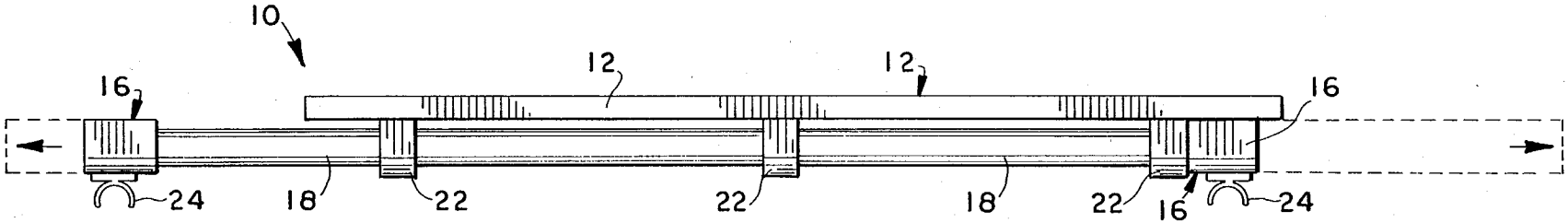
FIG. 2 is a front elevational view of the embodiment shown in FIG. 1.
Figure 3:
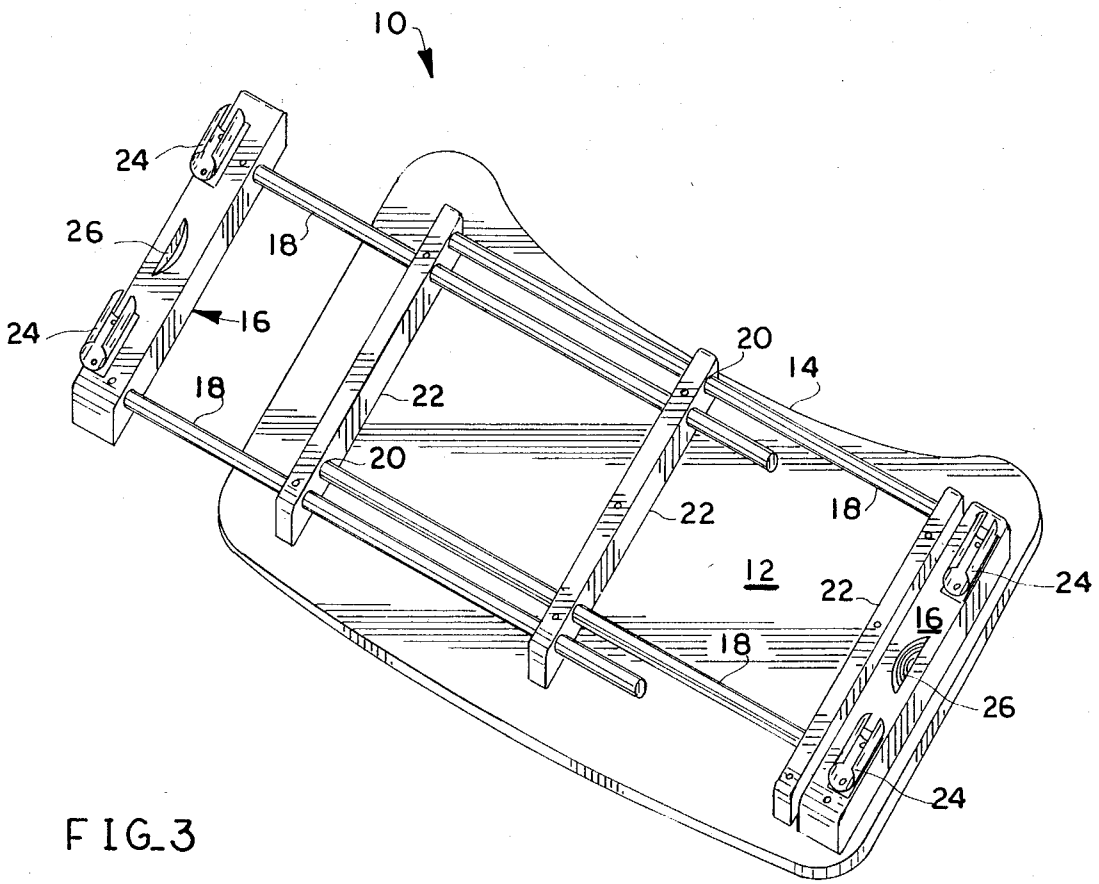
FIG. 3 is a bottom perspective view of the embodiments shown in FIGS. 1 and 2.

Referring now to FIG. 1, it will there be seen that the preferred embodiment of the invention is designated by the reference numeral 10 as a whole. The tray 10 includes a base member 12 of generally rectangular configuration, and having a curvilinear rearward edge 14 to accommodate the midsection of a patient sitting in a bed or chair at mealtime. The base member 12, as best shown in FIG. 2, is flat and of planar configuration so that it serves as a support surface for the items served to the patient. A pair of laterally spaced handle members 16, 16 are disposed below the plane of the base member 12 as shown in FIG. 2, and extend laterally relative to such base member 12. A pair of elongate rod members are fixedly secured, by suitable means, and extend laterally from each of the handle members 16, in parallelism to one another, but axially offset one another, as shown in FIG. 3. The rod members 18 are slidably disposed within complementally formed apertures, collectively designated 20, formed in guide members 22. Each guide member 22 is fixedly secured to and depends to the bottom surface of the face member 12. The guide members 22 are equidistantly spaced as shown and are parallel to one another and are positioned so that contiguous ones of the apertures 22 are axially aligned with one another to cooperatively receive an associated rod 18.

Accordingly, the handle members 16 are independently slidable relative to the guide members 22 as shown in FIG. 3, which shows one handle member in an extended configuration and the other handle member in its fully retracted, or stored, position.

Clamping members 24 are fixedly secured to, and depend to, the underside of each handle member 16 as shown. Each clamping member 24 is formed of a resilient material such as plastic and is provided with an elongate slot parallel to the longitudinal axis of symmetry of such clamping member, said slot being formed at the lowermost portion of its associated clamping member 24. Thus, each clamping member 24 will releasably engage a tubular member of the type commonly used to form a bed frame or a wheelchair frame attendant transient deformation of such clamping member 24.

A recess portion 26 is formed mid-length of each handle member 16 as shown to accommodate the fingers of a hand gripping such handle 16 to facilitate the manipulation of the handles.

Accordingly, when it is desired to serve a patient, the handles 16 are gripped and the clamping members 24 are aligned with oppositely disposed, preselected portions of the tubular frame that defines the patient's bed or chair. The preselected frame portions are inserted through the slot formed in each clamping member 24, and the tray is in position for use. The procedure is reversed to remove the tray from the frame portion. The tray is stored by locating a different portion of the frame that defines the chair or bed and clamping tray 10 thereto by following a similar procedure. Preferably, the tray 10 is detachably mounted to the side rails of the patient's bed so that it will be readily accessible when again needed. Alternatively, the tray can be detachably secured to the footboard of the bed or to the headboard thereof.

Figure 4:
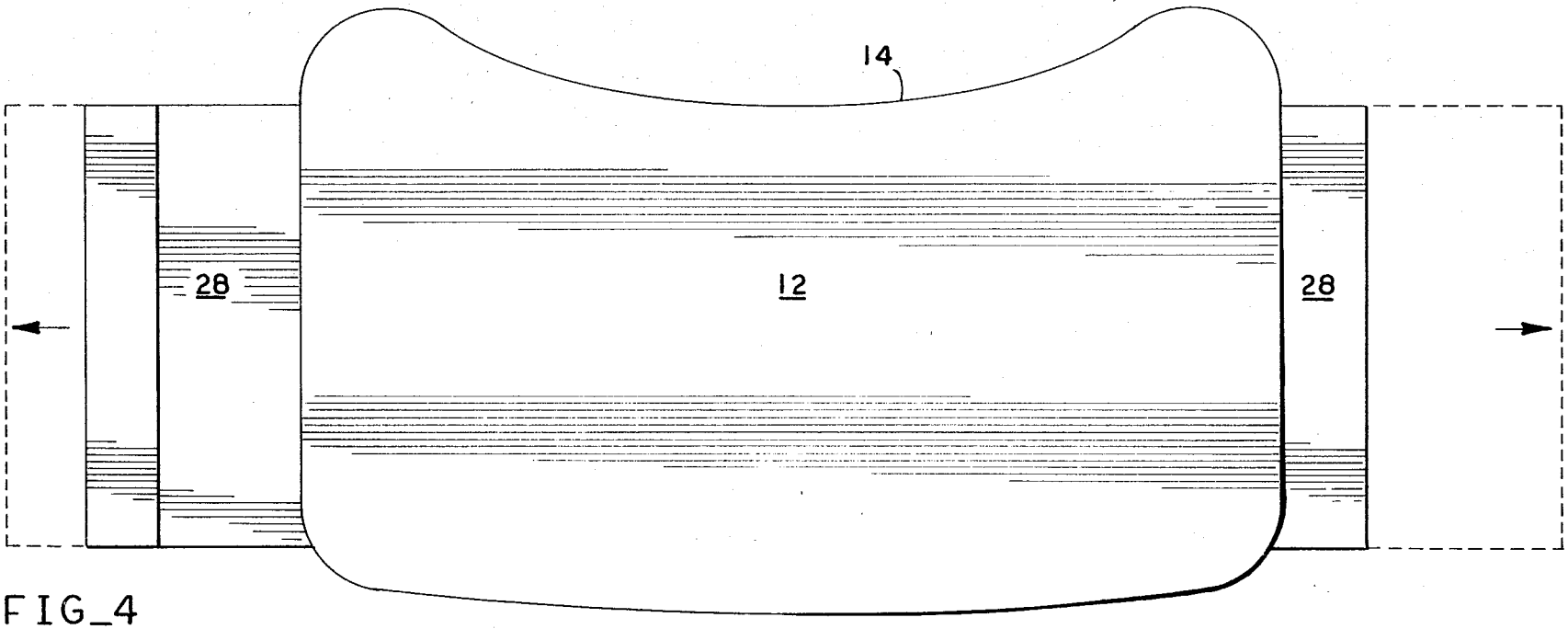
FIG. 4 is a top plan view of a second embodiment of the invention.
Figure 5:
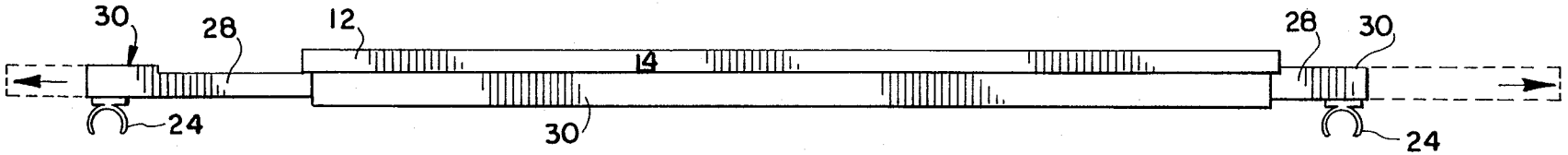
FIG. 5 is a front elevational view of the embodiment shown in FIG. 4.
Figure 6:
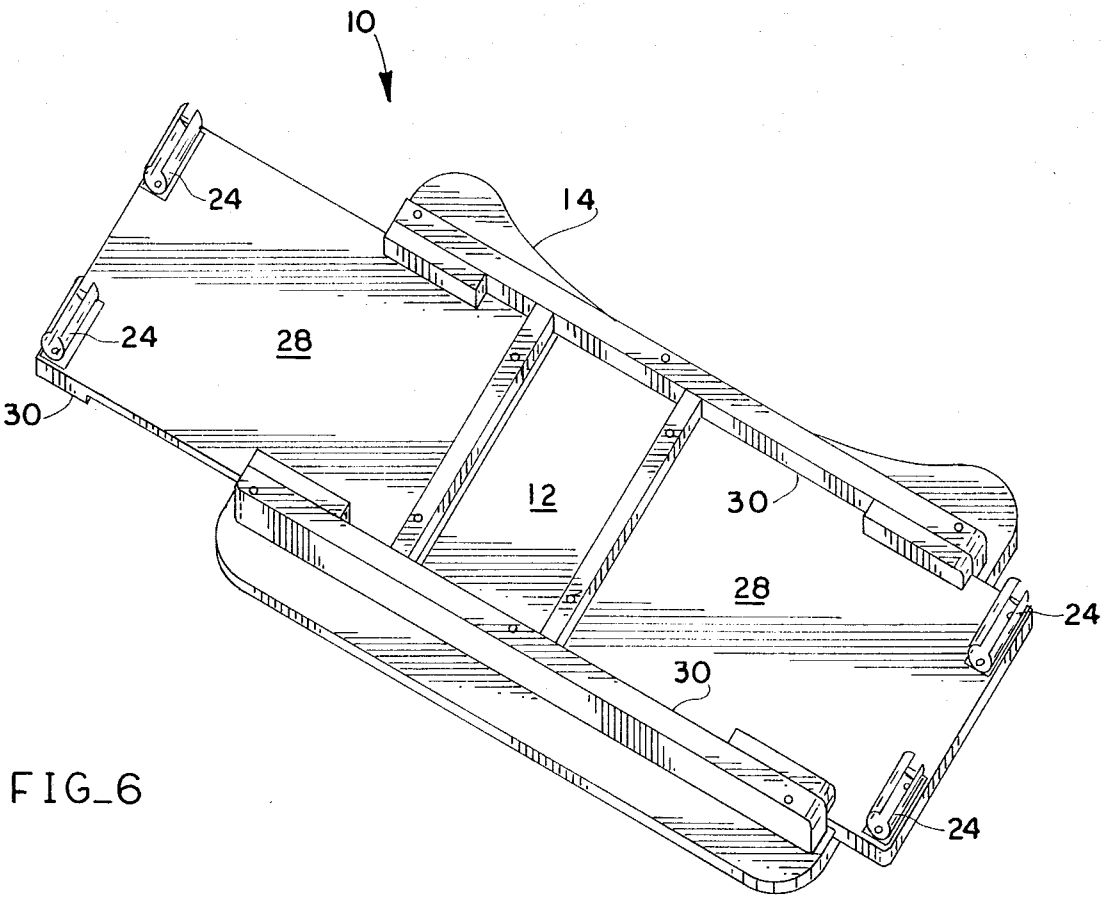
FIG. 6 is a bottom perspective view of the embodiment shown in FIGS. 4 and 5.

The embodiment shown in FIGS. 4–6 provides a pair of laterally extensible panel members 28, 28 in lieu of the handle and rod members 16, 18 respectively of the first-described embodiment. Each panel member 28 is of generally planar construction, although each panel 28 has an offset portion 30 formed at its distal free end to serve as a stop means, as perhaps best shown in FIG. 5.

The panel members 18 are slidably disposed relative to a pair of transversely spaced guide members 30, 30. In all other respects, the embodiment of FIGS. 4–6 is substantially the same as the earlier-described embodiment.

The novel construction is thus seen to require far fewer materials to construct than a conventional overbed tray. It is lightweight and can be stored on the side of a bed or other location thereon, or on a wheelchair or any other bodily support structure having a frame of tubular materials. The plastic clamping members 24 are durable and make the inventive tray easy to attach and detach to a tubular frame. Most importantly, the lateral extensibility of the handles 16 or the panels 28 provide a highly versatile tray that overcomes the limitations of the trays that were known heretofore.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A tray member of the type designed to be detachably secured to the frame of structures having tubular frames, comprising, a flat, generally rectangular base member having a top article-supporting surface and a bottom surface, a first guide member fixedly secured to the bottom surface of said base member, said first guide member disposed normal to the longitudinal axis of said base member and positioned adjacent a first lateral edge of said base member, said first guide member provided with proximal and distal aperture members formed therein, a second guide member fixedly secured to the bottom surface of said base member, said second guide member disposed parallel to said first guide member and positioned adjacent a second lateral edge of said base member, said second guide member provided with proximal and distal aperture members formed therein, a third guide member fixedly secured to the bottom surface of said base member, said third guide member disposed parallel to said first and second guide members and positioned intermediate thereof, said third guide member provided with a first pair of proximal aperture members formed therein and a second pair of distal aperture members formed therein, said first pair of aperture members being respectively axially aligned with the proximal aperture members formed in said first and second guide members, said second pair of aperture members being respectively axially aligned with the distal aperture members formed in said first and second guide members, a first handle member disposed parallel to said first, second and third guide members, a proximal elongate rod member and a distal elongate rod member fixedly secured to sad first handle member and projecting laterally therefrom and respectively positioned so that the proximal rod member is slideably engaged with the proximal aperture member formed in said first guide member and with a first one of the proximal aperture members formed in said third guide member and so that the distal rod member is slideably engaged with the distal aperture member formed in said first guide member and with a second one of said proximal aperture members formed in said third guide member, a second handle member disposed parallel to said first handle member, a proximal elongate rod member and a distal elongate rod member fixedly secured to said second handle member and projecting laterally therefrom and respectively positioned so that the proximal rod member is slideably engaged with the proximal aperture member formed in said second guide member and with a second one of the proximal aperture members formed in said third guide member and so that the distal rod member is slideably engaged with the distal aperture member formed in said second guide member and with a second one of said distal aperture members formed in said third guide member, said rod members collectively having a length substantially equal to the distance between said first and second guide members so that said first and second guide members act as stop means that limit the inwardly directed travel of said rod members, and said first and second guide members being spaced inwardly from the first and second lateral edges of said base member, respectively, by a distance substantially equal to the width of said first and second handle members so that said handle members are fully retractable beneath said base member to thereby decrease the amount of space occupied by said tray member when it is stored.

2. The tray member of claim 1, further comprising, a tray mounting means for releasably securing said first and second handle members to the frame of the tubular structure, said mounting means including a tubular frame clamping means fixedly secured to the bottom surface of said first handle member, said mounting means further including a tubular frame clamping means fixedly secured to the bottom surface of said second handle member, said mounting means further including access means so that said first and second handle members may be gripped when said clamping means are disposed in frame-engaging relation to said tubular frame, said access means including a first recess means formed in a bottom surface of said first handle member and a second recess means formed in a bottom surface of said second handle member.

3. The tray of claim 2, wherein said clamping means associated with said first and second handle members include a pair of spaced clamping members and wherein the recess means formed in the respective handle members are disposed intermediate their associated clamping members.

* * * * *